US011685877B2

(12) United States Patent
Che et al.

(10) Patent No.: US 11,685,877 B2
(45) Date of Patent: Jun. 27, 2023

(54) SUPER-LUBRICITY WATER LUBRICATING ADDITIVE, SUPER-LUBRICITY WATER LUBRICANT, PREPARATION METHOD AND APPLICATION

(71) Applicant: QINGDAO UNIVERSITY OF TECHNOLOGY, Shandong (CN)

(72) Inventors: Qinglun Che, Qingdao (CN); Jianjun Zhang, Qingdao (CN); Sen Liang, Qingdao (CN); Ning Cui, Qingdao (CN); Binjiang Lv, Qingdao (CN); Yang Xu, Qingdao (CN); Xinghua Ma, Qingdao (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 128 days.

(21) Appl. No.: 17/421,219

(22) PCT Filed: Jul. 21, 2020

(86) PCT No.: PCT/CN2020/103349
§ 371 (c)(1),
(2) Date: Jul. 7, 2021

(87) PCT Pub. No.: WO2021/243824
PCT Pub. Date: Dec. 9, 2021

(65) Prior Publication Data

US 2022/0340834 A1 Oct. 27, 2022

(30) Foreign Application Priority Data

Jun. 4, 2020 (CN) ..... 202010498505.0

(51) Int. Cl.
*C10M 173/02* (2006.01)
*C10M 125/02* (2006.01)
(Continued)

(52) U.S. Cl.
CPC ..... *C10M 173/02* (2013.01); *C10M 125/02* (2013.01); *C10M 161/00* (2013.01);
(Continued)

(58) Field of Classification Search
CPC ..... C10M 125/02; C10M 161/00; C10M 173/02; C10M 2201/02; C10M 2201/041;
(Continued)

(56) References Cited

U.S. PATENT DOCUMENTS 10,586,979 B2 3/2020 Chen et al.
2016/0311132 A1* 10/2016 Yan ..... B05D 1/18
(Continued)

FOREIGN PATENT DOCUMENTS

CN 105949861 A 9/2016
CN 106582562 A * 4/2017
(Continued)

OTHER PUBLICATIONS

Fabrication and Tribological Investigation of a Novel Hydrophobic Polydopamine Graphene Oxide Multilayer Film; Junfei Ou Lei Liu Jinquing Wang; Fajun Wang, Mingshan Xue Wen Li Tribology Letters 48, 407-415 (2012) (Year: 2012).*
(Continued)

*Primary Examiner* — James C Goloboy
(74) *Attorney, Agent, or Firm* — Oliff PLC

(57) ABSTRACT

A super-lubricity water lubricating additive, a super-lubricity water lubricant, a preparation method and application, wherein the additive is of a hollow spherical shell structure which includes at least one layer of spherical shell; the spherical shell sequentially includes a first polydopamine layer, a nanoparticle layer, a second polydopamine layer and an oxidized graphene layer from inside to outside, or a first polydopamine layer, a nanoparticle layer, a second polydopamine layer, a graphene layer and a third polydopamine
(Continued)

layer from inside to outside; and nanoparticles of the nanoparticle layer are nano diamond, nano molybdenum disulfide or nano tungsten disulfide. The additive is prepared into a uniform aqueous solution to obtain the super-lubricity water lubricant. The additive can be easily adsorbed on a dual surface, and the nanoparticles released in a friction process cooperate with spherical oxidized graphene or graphene to form rolling friction so as to reduce frictional abrasion.

8 Claims, 2 Drawing Sheets

(51) Int. Cl.
*C10M 161/00* (2006.01)
*C10N 20/06* (2006.01)
*C10N 30/06* (2006.01)

(52) U.S. Cl.
CPC ... *C10M 2201/02* (2013.01); *C10M 2201/041* (2013.01); *C10M 2201/062* (2013.01); *C10M 2201/066* (2013.01); *C10M 2217/046* (2013.01); *C10N 2020/06* (2013.01); *C10N 2030/06* (2013.01)

(58) Field of Classification Search
CPC ..... C10M 2201/062; C10M 2201/066; C10M 2217/046; C10N 2020/06; C10N 2030/06
See application file for complete search history.

(56) References Cited

U.S. PATENT DOCUMENTS

| | | | |
|---|---|---|---|
| 2018/0351166 | A1 | 12/2018 | Chen et al. |
| 2020/0099054 | A1 | 3/2020 | Liu et al. |

FOREIGN PATENT DOCUMENTS

| | | | | | |
|---|---|---|---|---|---|
| CN | 107164020 | A | * | 9/2017 | ..... B22F 9/24 |
| CN | 107164020 | A | | 9/2017 | |
| CN | 108352514 | A | | 7/2018 | |
| CN | 110253995 | A | * | 9/2019 | ..... B32B 15/08 |
| CN | 110770947 | A | | 2/2020 | |
| CN | 108417853 | A | * | 4/2020 | |

OTHER PUBLICATIONS

Mar. 3, 2021 International Search Report issued in International Patent Application No. PCT/CN2020/103349.
Mar. 3, 2021 Written Opinion issued in International Patent Application No. PCT/CN2020/103349.

* cited by examiner

SUPER-LUBRICITY WATER LUBRICATING ADDITIVE, SUPER-LUBRICITY WATER LUBRICANT, PREPARATION METHOD AND APPLICATION

BACKGROUND

Technical Field

The present invention relates to a super-lubricity water lubricating additive, a super-lubricity water lubricant, a preparation method and application.

Related Art

Information of the Related Art part is merely disclosed to increase the understanding of the overall background of the present invention, but is not necessarily regarded as acknowledging or suggesting, in any form, that the information constitutes the prior art known to a person of ordinary skill in the art.

A mechanical motion component consumes energy sources due to friction in the motion process, and is abraded to cause failure and damage, so that huge economic loss is brought to people, and at the same time, environmental pollution will be caused. How to recognize and control the frictional abrasion of key components such as motor vehicles and micro-nano mechanical assemblies becomes a key point. Scientists found that almost zero friction and abrasion exist between Van Der Waals solid surfaces (surfaces of two-dimensional materials such as graphene and molybdenum disulfide) in incommensurate contact, and a friction coefficient of a super-lubricity phenomenon is defined to be less than 0.01. Super-lubricity will have profound significance in aspects of energy saving, cost reduction and environment safety. Although scientists have developed and used various kinds of solid and liquid lubricants, a super-lubricity behavior is rarely achieved on a macroscopic or engineering scale. Environmental problems caused by friction of the mechanical motion component in the motion process gradually enter the visual field of people, and a water medium lubricant with low price and environment-friendly effects receives more and more attention from people in the field of tribology. Through studies, the inventor of the present invention found that under the condition of boundary lubrication or mixed lubrication, the lubrication performance of pure water is poor, a water film is easy to break, and metal surfaces are in direct contact, i.e., solid-solid contact, so that its application to the fields of motion components and joint liquid lubrication is greatly limited.

SUMMARY

In order to overcome the defects in the prior art, the objective of the present invention is to provide a super-lubricity water lubricating additive, a super-lubricity water lubricant, a preparation method and application. The bearing capability of the water lubricant can be enhanced, and the frictional abrasion are reduced.

To achieve the objective, the present invention includes the following technical solutions:

In one aspect, a super-lubricity water lubricating additive is provided, and is of a hollow spherical shell structure, and the hollow spherical shell structure includes at least one layer of spherical shell.

The spherical shell sequentially includes a first polydopamine layer, a nanoparticle layer, a second polydopamine layer and an oxidized graphene layer from inside to outside, and nanoparticles of the nanoparticle layer are nano diamond, nano molybdenum disulfide or nano tungsten disulfide.

Or the spherical shell sequentially includes a first polydopamine layer, a nanoparticle layer, a second polydopamine layer, a graphene layer and a third polydopamine layer from inside to outside, and nanoparticles of the nanoparticle layer are nano diamond, nano molybdenum disulfide or nano tungsten disulfide.

In another aspect, a preparation method of a super-lubricity water lubricating additive is provided, and includes: preparing a first polydopamine layer on a surface of a spherical nano metal oxide, connecting nanoparticles to a surface of the first polydopamine layer to load a nanoparticle layer onto the surface of the first polydopamine layer, then, preparing a second polydopamine layer on a surface of the nanoparticle layer, enabling oxidized graphene to form an oxidized graphene layer on a surface of the second polydopamine layer through bonding hydroxyl groups or $\pi$-$\pi$ bonds to surface groups of the oxidized graphene on the surface of the second polydopamine layer, and removing the nano metal oxide by an acid solution through etching, wherein the nanoparticles are nano diamond, nano molybdenum disulfide or nano tungsten disulfide.

Or preparing a first polydopamine layer on a surface of a spherical nano metal oxide, connecting nanoparticles to a surface of the first polydopamine layer to load a nanoparticle layer onto the surface of the first polydopamine layer, then, preparing a second polydopamine layer on a surface of the nanoparticle layer, enabling oxidized graphene to form an oxidized graphene layer on a surface of the second polydopamine layer through bonding hydroxyl groups or $\pi$-$\pi$ bonds to surface groups of the oxidized graphene on the surface of the second polydopamine layer, preparing a third polydopamine layer on a surface of the oxidized graphene layer from dopamine, reducing the oxidized graphene into graphene by dopamine during preparation of the third polydopamine layer, and removing the nano metal oxide by an acid solution through etching, wherein the nanoparticles are nano diamond, nano molybdenum disulfide or nano tungsten disulfide.

In a third aspect, a super-lubricity water lubricant is provided, and is an aqueous solution of the super-lubricity water lubricating additive.

In a fourth aspect, application of the super-lubricity water lubricant to a mechanical motion component or biological lubrication is provided.

The Present Invention has the Following Beneficial Effects

1. According to the present invention, deionized water is used as lubricating liquid, and an in-situ assembled spherical hollow oxidized graphene or graphene/nanoparticle composite material is used as a lubricating additive, and in-situ assembled spherical hollow oxidized graphene or graphene/nanoparticles roll on a friction surface to reduce frictional abrasion. The polydopamine contains a great number of hydroxyl groups and amino groups, and can be easy adsorbed to a surface of a friction pair. Additionally, the polydopamine can be easily dispersed in water, and the super-lubricity water lubricant with different additive mass concentrations can be obtained through the preparation under the atmospheric environment condition. The preparation is simple, the operation is easy, the process is stable, the quality is reliable, the cost is low, renewable and pollutionfree effects are achieved, and the additive can be easily adsorbed on a dual surface to form a transfer film, and meets the commercial engineering macroscopical use requirements as an advanced lubricant material.

2. The super-lubricity water lubricant obtained according to the present invention can be stored for 1-2 years without an obvious precipitation phenomenon and has a long shelf life.

3. Tribology tests show that the water lubricant obtained according to the present invention has super-lubricity lubricating behaviors and abrasion-resistant performance, so that the water lubricant can be used as a super-lubricity lubricant material for a mechanical motion component or a biological lubricating component in an atmospheric environment.

BRIEF DESCRIPTION OF THE DRAWINGS

The accompanying drawings constituting a part of the present invention are used to provide a further understanding of the present invention. The exemplary examples of the present invention and descriptions thereof are used to explain the present invention, and do not constitute an improper limitation of the present invention.

DETAILED DESCRIPTION

Figure 1:
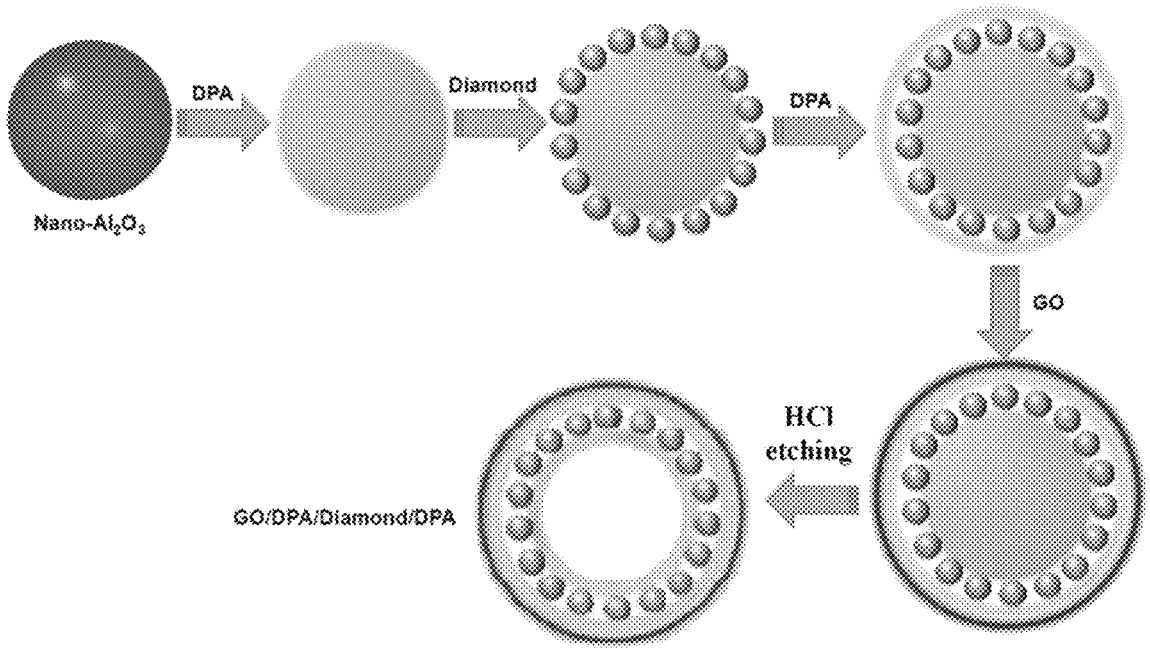
FIG. 1 is a schematic diagram of a preparation process of Embodiment 1 of the present invention.

It should be noted that, the following detailed descriptions are all exemplary, and are intended to provide further descriptions of the present disclosure. Unless otherwise specified, all technical and scientific terms used herein have the same meanings as those usually understood by a person of ordinary skill in the art to which the present disclosure belongs.

It should be noted that the terms used herein are merely used for describing specific implementations, and are not intended to limit exemplary implementations of the present disclosure. As used herein, the singular form is also intended to include the plural form unless the context clearly dictates otherwise. In addition, it should further be understood that, terms "comprise" and/or "include" used in this specification indicate that there are features, steps, operations, devices, components, and/or combinations thereof.

In view of the problems of poor lubricating performance and easy breakage of a water film and the like of pure water, the present invention provides a super-lubricity water lubricating additive, a super-lubricity water lubricant, a preparation method and application.

In a typical implementation of the present invention, a super-lubricity water lubricating additive is provided. The super-lubricity water lubricating additive is of a hollow spherical shell structure, and the hollow spherical shell structure includes at least one layer of spherical shell.

The spherical shell sequentially includes a first polydopamine layer, a nanoparticle layer, a second polydopamine layer and an oxidized graphene layer from inside to outside, and nanoparticles of the nanoparticle layer are nano diamond, nano molybdenum disulfide or nano tungsten disulfide.

Or the spherical shell sequentially includes a first polydopamine layer, a nanoparticle layer, a second polydopamine layer, a graphene layer and a third polydopamine layer from inside to outside, and nanoparticles of the nanoparticle layer are nano diamond, nano molybdenum disulfide or nano tungsten disulfide.

According to another implementation of the present invention, a preparation method of the super-lubricity water lubricating additive is provided. A first polydopamine layer is prepared on a surface of a spherical nano metal oxide. Nanoparticles are connected to a surface of the first polydopamine layer to load a nanoparticle layer onto the surface of the first polydopamine layer. Then, a second polydopamine layer is prepared on a surface of the nanoparticle layer. Oxidized graphene is enabled to form an oxidized graphene layer on a surface of the second polydopamine layer through bonding hydroxyl groups or π-π bonds to surface groups of the oxidized graphene on the surface of the second polydopamine layer. The nano metal oxide is removed by an acid solution through etching. The nanoparticles are nano diamond, nano molybdenum disulfide or nano tungsten disulfide.

Or, a first polydopamine layer is prepared on a surface of a spherical nano metal oxide. Nanoparticles are connected to a surface of the first polydopamine layer to load a nanoparticle layer onto the surface of the first polydopamine layer. Then, a second polydopamine layer is prepared on a surface of the nanoparticle layer. Oxidized graphene is enabled to form an oxidized graphene layer on a surface of the second polydopamine layer through bonding hydroxyl groups or π-π bonds to surface groups of the oxidized graphene on the surface of the second polydopamine layer. A third polydopamine layer is prepared on a surface of the oxidized graphene layer from dopamine. The oxidized graphene is reduced into graphene by dopamine during preparation of the third polydopamine layer. The nano metal oxide is removed by an acid solution through etching. The nanoparticles are nano diamond, nano molybdenum disulfide or nano tungsten disulfide.

The spherical nano metal oxide (10-150 nm) in the present invention is, for example, nano aluminum oxide and nano copper oxide.

By using the method, the super-lubricity water lubricating additive of a one-layer spherical shell structure can be obtained. If a super-lubricity water lubricating additive of a two-or-more-layer spherical shell structure needs to be obtained, the obtained super-lubricity water lubricating additive of the one-layer spherical shell structure replaces the nano metal oxide to repeat the above preparation method.

In some embodiments of the implementation, a process of preparing the first polydopamine layer on the surface of the spherical nano metal oxide includes: adding a nano metal oxide into a dopamine polymerization reaction system to take a polymerization reaction. The dopamine polymerization reaction system includes dopamine hydrochloride, Tris solution and hydrochloric acid. The dopamine hydrochloride can be replaced by dopamine. pH in the dopamine polymerization reaction system is 8.0-9.0.

In some embodiments of the implementation, a process of connecting the nanoparticles to the surface of the first polydopamine layer includes: adding nanoparticle dispersion liquid into a nano metal oxide solution cladded by the first polydopamine layer to be mixed for 10-24 h.

In some embodiments of the implementation, a process of preparing the second polydopamine layer on the surface of the nanoparticle layer includes: adding a composite material loaded with the nanoparticle layer on the surface of the first polydopamine layer into a dopamine polymerization reaction system to take a polymerization reaction, and the dopamine polymerization reaction system includes dopamine hydrochloride, Tris solution and hydrochloric acid. The dopamine hydrochloride can be replaced by dopamine. pH in the dopamine polymerization reaction system is 8.0-9.0.

In some embodiments of the implementation, a process of forming the oxidized graphene layer on the surface of the second polydopamine layer includes: adding a composite material for preparing the second polydopamine layer on the surface of the nanoparticle layer into oxidized graphene dispersion liquid to be mixed for 10-24 h.

In some embodiments of the implementation, freeze-drying is performed after the nano metal oxide is removed through etching.

In some embodiments of the implementation, a process of preparing the third polydopamine layer is identical to the process of preparing the second polydopamine layer.

In some embodiments of the implementation, the preparation method of the oxidized graphene is a Hummer improving method.

According to a third implementation of the present invention, a super-lubricity water lubricant is provided, and is an aqueous solution of the above super-lubricity water lubricating additive.

In some embodiments of the implementation, a mass concentration of the super-lubricity water lubricating additive is 0.01-1.00%. When the mass concentration of the super-lubricity water lubricating additive reaches 0.45-0.55%, the friction performance is better. After the frictional abrasion test in an atmospheric environment, the friction coefficient can reach 0.006, and a super-lubricity behavior is achieved, so that the prepared super-lubricity water lubricant can meet the lubricating requirements on materials or parts with high requirements on the lubricating performance.

According to a fourth implementation of the present invention, application of the above super-lubricity water lubricant to a mechanical motion component or biological lubrication is provided.

The biological lubrication of the present invention is, for example, joint liquid lubrication.

In order to make the technical solution of the present invention more clearly understood by those skilled in the art, the technical solution of the present invention will be described in detail below with the reference to specific embodiments and comparative examples.

Example 1

(1) A Hummer improving method was used for preparing an oxidized graphene solution: firstly, a 1000 ml dry flask was cooled for 5 min in an ice water bath. Then, 100 ml of concentrated sulfuric acid was added. In a stirring process, 2 g of crystalline flake graphite, 1.2 g of sodium nitrate and 8.0 g of potassium permanganate were added. A reaction temperature was controlled at 5° C. by the ice water bath, and a magnetic stirring reaction was performed for 2 h. Then, the flask was taken out to be placed on a constant-temperature heating magnetic stirrer to take a magnetic stirring reaction for 2 h under the condition of 35° C. Finally, 150 ml of deionized water was added. Next, the reaction temperature was raised to 95° C. by the constant-temperature heating stirrer. The magnetic stirring was continuously performed for 1 h to obtain an oxidized graphene solution with the concentration of 50 mg/ml. The deionized water was added for diluting the oxidized graphene solution. Ultrasonic concussion was performed for 2 h to obtain an oxidized graphene aqueous solution. The oxidized graphene aqueous solution was placed into a refrigerator to be completely frozen into an ice block. Then, the ice block was taken out to be placed into a freeze-drying machine to be subjected to freezing, vacuum pumping and drying to obtain oxidized graphene powder.

(2) 20 ml of deionized water was added into a 50 ml flask. 0.2 ml of a dopamine hydrochloride solution (2.0 mg/ml) and 5.0 ml of Tris solution (0.1 mol/l) were taken to be added into the deionized water. 2.0 ml of an HCl solution (0.1 mol/l) prepared in advance was added into the above solution. The pH of the solution was adjusted to be 8.5 to obtain a dopamine polymerization solution. Next, 100 mg of nano $Al_2O_3$ powder was added into the dopamine polymerization solution. The whole solution was subjected to magnetic stirring for 12 h to obtain polydopamine in situ grafted on the surface of the nano $Al_2O_3$. Then, a nanoparticle colloid aqueous solution with a preparation concentration of 0.1 g/ml was added into the above solution, and magnetic stirring was performed for 12 h. The obtained solution was centrifuged for 20 min at 10000 r/min. After supernatant was abandoned, nano diamond/polydopamine/nano $Al_2O_3$ slurry was obtained. The obtained nano diamond/polydopamine/nano $Al_2O_3$ slurry was baked, centrifuged and dried to obtain black powder. The black powder was added into the polydopamine polymerization solution. The whole solution was subjected to magnetic stirring for 12 h to obtain a polydopamine/nano diamond/polydopamine/nano $Al_2O_3$ composite material.

(3) 5 mg of the polydopamine/nano diamond/polydopamine/nano $Al_2O_3$ composite material in (2) was weighed and added into the oxidized graphene solution with the concentration of 1.5 mg/ml. Then, magnetic stirring was performed for 12 h to obtain a single-layer oxidized graphene/polydopamine/nano diamond/polydopamine/nano $Al_2O_3$ composite material.

(4) 5.0 ml of an HCl solution (excessive hydrochloric acid) with the preparation concentration of 0.1 mol/l was added into the oxidized graphene/nano diamond/polydopamine/nano $Al_2O_3$ composite material in (3). The kernel nano $Al_2O_3$ was etched to obtain a hollow spherical oxidized graphene/nanoparticle solution. The obtained solution was placed into a centrifugal machine to be centrifuged for 20 min at 10000 r/min. After supernatant was abandoned, obtained hollow spherical oxidized graphene/nanoparticle slurry was placed into a freeze-drying machine to be frozen and dried to obtain black powder. A synthesis process was as shown in FIG. 1.

(5) 50 mg of the black powder in (4) was added into a flask containing deionized water. An opening of the flask containing the black powder in (4) and the deionized water was sealed at a room temperature, and ultrasonic concussion was performed for 2 h. Next, a uniformly mixed solution with a mass concentration of 0.50% was obtained. The super-lubricity water lubricant was obtained.

Example 2

The present embodiment was identical to Embodiment 1. The difference was that the concentration of the oxidized graphene solution in step (3) was 0.5 mg/ml.

Example 3

The present embodiment was identical to Embodiment 1. The difference was that the concentration of the oxidized graphene solution in step (3) was 1.0 mg/ml.

Example 4

The present embodiment was identical to Embodiment 1. The difference was that the concentration of the oxidized graphene solution in step (3) was 2.0 mg/ml.

Example 5

The present embodiment was identical to Embodiment 1. The difference was that the concentration of the oxidized graphene solution in step (3) was 2.5 mg/ml.

Example 6

The present embodiment was identical to Embodiment 1. The difference was that in step (5), the mass of the added black powder in (4) was 1 mg, and the uniformly mixed solution with the mass concentration of 0.01% was prepared.

Example 7

The present embodiment was identical to Embodiment 1. The difference was that in step (5), the mass of the added black powder in (4) was 5 mg, and the uniformly mixed solution with the mass concentration of 0.05% was prepared.

Example 8

The present embodiment was identical to Embodiment 1. The difference was that in step (5), the mass of the added black powder in (4) was 10 mg, and the uniformly mixed solution with the mass concentration of 0.10% was prepared.

Example 9

The present embodiment was identical to Embodiment 1. The difference was that in step (5), the mass of the added black powder in (4) was 20 mg, and the uniformly mixed solution with the mass concentration of 0.20% was prepared.

Example 10

The present embodiment was identical to Embodiment 1. The difference was that in step (5), the mass of the added black powder in (4) was 30 mg, and the uniformly mixed solution with the mass concentration of 0.30% was prepared.

Example 11

The present embodiment was identical to Embodiment 1. The difference was that in step (5), the mass of the added black powder in (4) was 40 mg, and the uniformly mixed solution with the mass concentration of 0.40% was prepared.

Example 12

The present embodiment was identical to Embodiment 1. The difference was that in step (5), the mass of the added black powder in (4) was 100 mg, and the uniformly mixed solution with the mass concentration of 1.00% was prepared.

Example 13

The present embodiment was identical to Embodiment 1. The difference was that the single-layer oxidized graphene/nano diamond/polydopamine/nano $Al_2O_3$ composite material obtained in step (3) was used for replacing nano $Al_2O_3$ in step (2), the steps (2)-(3) were repeated for 1 time to obtain a two-layer oxidized graphene/nano diamond/polydopamine/nano $Al_2O_3$ composite material, and the two-layer oxidized graphene/nano diamond/polydopamine/nano $Al_2O_3$ composite material was continuously treated by the steps (4)-(5).

Example 14

The present embodiment was identical to Embodiment 13. The difference was that the two-layer oxidized graphene/nano diamond/polydopamine/nano $Al_2O_3$ composite material was used for replacing nano $Al_2O_3$ in step (2), the steps (2)-(3) were repeated for 1 time to obtain a three-layer oxidized graphene/nano diamond/polydopamine/nano $Al_2O_3$ composite material, and the three-layer oxidized graphene/nano diamond/polydopamine/nano $Al_2O_3$ composite material was continuously treated by the steps (4)-(5).

Example 15

The present embodiment was identical to Embodiment 1. The difference was that the nano diamond was replaced by nano $MoS_2$.

Example 16

The present embodiment was identical to Embodiment 1. The difference was that the nano diamond was replaced by nano $WS_2$.

Example 17

(1) A Hummer improving method was used for preparing an oxidized graphene solution: firstly, a 1000 ml dry flask was cooled for 5 min in an ice water bath. Then, 100 ml of concentrated sulfuric acid was added. In a stirring process, 2 g of crystalline flake graphite, 1.2 g of sodium nitrate and 8.0 g of potassium permanganate were added. A reaction temperature was controlled at 5° C. by the ice water bath, and a magnetic stirring reaction was performed for 2 h. Then, the flask was taken out to be placed on a constant-temperature heating magnetic stirrer to take a magnetic stirring reaction for 2 h under the condition of 35° C. Finally, 150 ml of deionized water was added. Next, the reaction temperature was raised to 95° C. by the constant-temperature heating stirrer. The magnetic stirring was continuously performed for 1 h to obtain an oxidized graphene solution with the concentration of 50 mg/ml. The deionized water was added for diluting the oxidized graphene solution. Ultrasonic concussion was performed for 2 h to obtain an oxidized graphene aqueous solution. The oxidized graphene aqueous solution was placed into a refrigerator to be completely frozen into an ice block. Then, the ice block was taken out to be placed into a freeze-drying machine to be subjected to freezing, vacuum pumping and drying to obtain oxidized graphene powder.

(2) 20 ml of deionized water was added into a 50 ml flask. 0.2 ml of a dopamine hydrochloride solution (2.0 mg/ml) and 5.0 ml of Tris solution (0.1 mol/l) were taken to be added into the deionized water. 2.0 ml of an HCl solution (0.1 mol/l) prepared in advance was added into the above solution. The pH of the solution was adjusted to be 8.5 to obtain a dopamine polymerization solution. Next, 100 mg of nano $Al_2O_3$ powder was added into the dopamine polymerization solution. The whole solution was subjected to magnetic stirring for 12 h to obtain polydopamine in situ grafted on the surface of the nano $Al_2O_3$. Then, a nanoparticle (nano diamond, $MoS_2$ and $WS_2$) colloid aqueous solution with a preparation concentration of 0.1 g/ml was added into the above solution, and magnetic stirring was performed for 12 h. The obtained solution was centrifuged for 20 min at 10000 r/min. After supernatant was abandoned, nanoparticle (nano diamond, $MoS_2$ and $WS_2$)/polydopamine/nano $Al_2O_3$ slurry was obtained. The obtained polydopamine/nanoparticle (nano diamond, $MoS_2$ and $WS_2$)/polydopamine/nano $Al_2O_3$ slurry was baked, centrifuged and dried to obtain black powder.

(3) 5 mg of the black powder in (2) was weighed and respectively added into oxidized graphene solutions with the concentrations of 0.5 mg/ml, 1.0 mg/ml, 1.5 mg/ml, 2.0 mg/ml and 2.5 mg/ml. Then, magnetic stirring was performed for 12 h. After the stirring, the solution was added into the polydopamine polymerization solution to obtain a single-layer polydopamine/graphene/polydopamine/nanoparticle (nano diamond, $MoS_2$ and $WS_2$)/polydopamine/nano $Al_2O_3$ composite material. In order to obtain multi-layer oxidized graphene/nanoparticles, i.e., a spherical polydopamine/graphene/nanoparticle (nano diamond, $MoS_2$ and $WS_2$)/polydopamine/nano $Al_2O_3$ composite material, the steps (2) and (3) are repeated, and a multi-layer polydopamine/graphene/polydopamine/nanoparticle (nano diamond, $MoS_2$ and $WS_2$)/polydopamine/nano $Al_2O_3$ composite material can be obtained.

Figure 2:
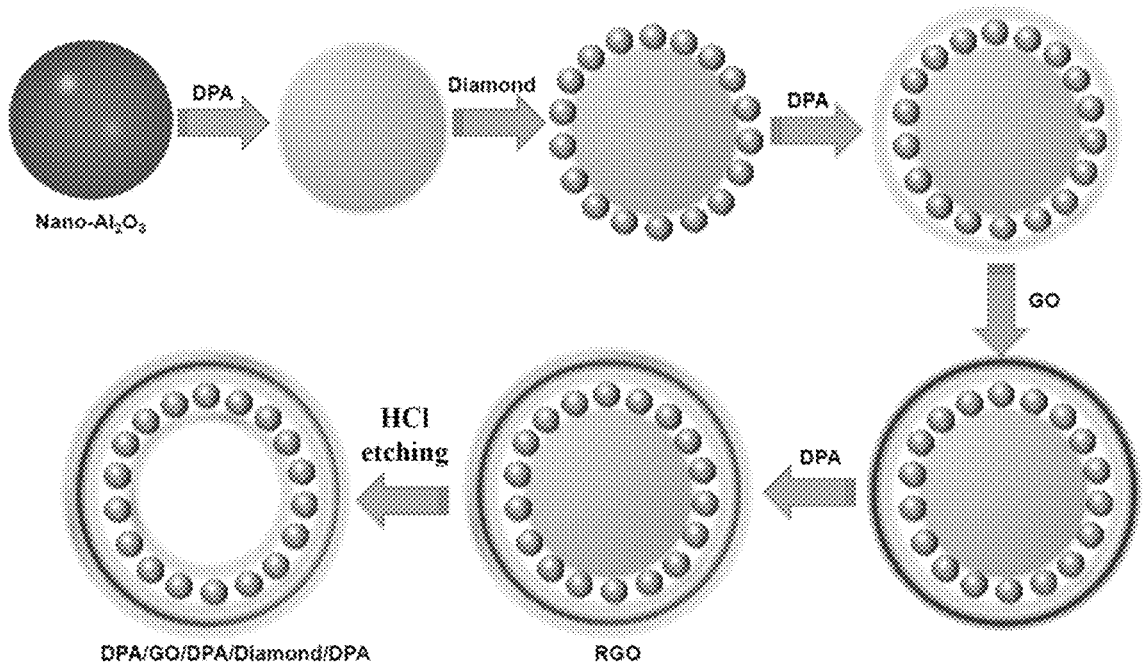
FIG. 2 is a schematic diagram of a preparation process of Embodiment 17 of the present invention.

(4) 5.0 ml of an HCl solution (excessive hydrochloric acid) with the preparation concentration of 0.1 mol/l was added into the polydopamine/graphene/polydopamine/nanoparticle (nano diamond, $MoS_2$ and $WS_2$)/polydopamine/nano $Al_2O_3$ composite material in (3). The kernel nano $Al_2O_3$ was etched to obtain a few-layer hollow spherical graphene or multilayer graphene/nanoparticle solution. The obtained solution was placed into a centrifugal machine to be centrifuged for 20 min at 10000 r/min. After supernatant was abandoned, obtained few-layer hollow spherical graphene or multilayer graphene/nanoparticle powder was placed into a freeze-drying machine to be frozen and dried to obtain black powder. A synthesis process of the few-layer hollow spherical graphene was as shown in FIG. 2.

(5) 1 mg, 5 mg, 10 mg, 20 mg, 30 mg, 40 mg and 50 mg of the black powder in (4) was added into flasks containing deionized water. Openings of the flasks containing the black powder in (4) and the deionized water were sealed at a room temperature, and ultrasonic concussion was performed for 2 h. Next, uniformly mixed solutions with mass concentrations of 0.01%, 0.05%, 0.10%, 0.20%, 0.30%, 0.40%, 0.50% and 1.00% were obtained. The super-lubricity water lubricant was obtained.

Tribology Performance Test

The deionized water and the water lubricant of the in-situ assembled hollow oxidized graphene/nanoparticle composite material additive prepared in Embodiment 1 were subjected to frictional abrasion test. The test was performed by using a ball-disc reciprocating frictional abrasion test machine in an atmospheric environment (US CETR corporation, UMT-3). A stainless steel disc was used as a lower sample to be fixed on a flat-bottom disc, and a steel ball with a diameter of 6.0 mm was used as a dual ball to be fixed on the stainless steel disc to be used as an upper sample. In the test, the sliding time was 1500 s, the sliding amplitude was 1 mm, the reciprocating frequency was 20 Hz, and the load was 1 N.

Figure 3:
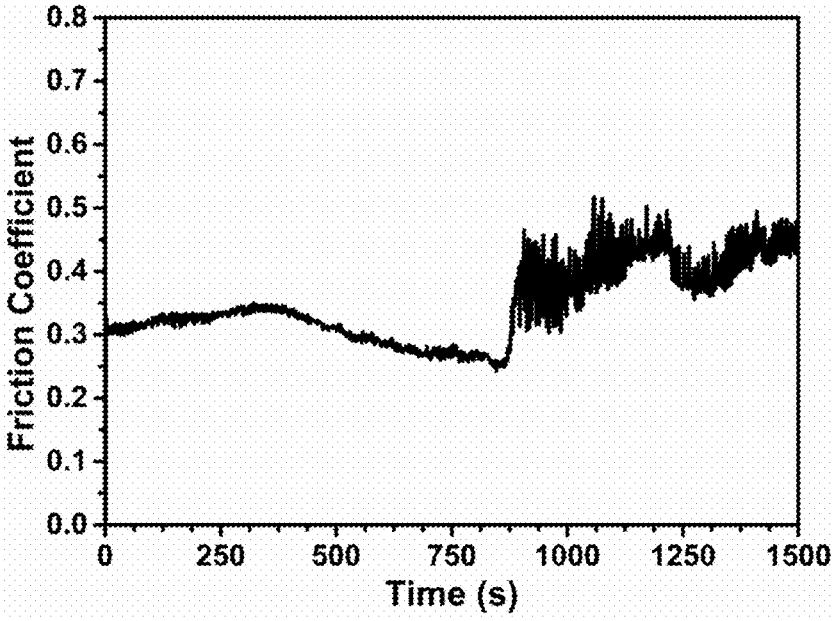
FIG. 3 is a friction test curve of a pure deionized water lubricant on a ball-disc.
Figure 4:
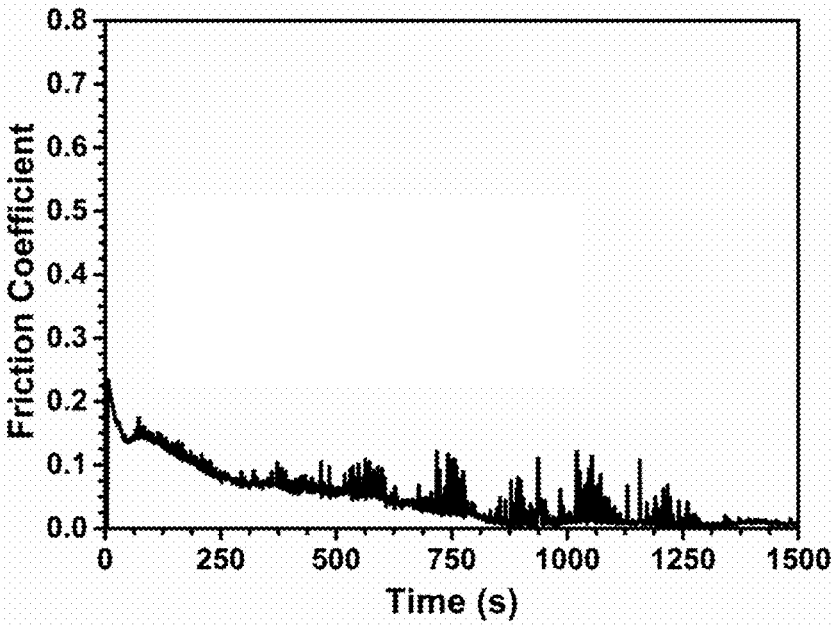
FIG. 4 is a friction test curve of a super-lubricity water lubricant prepared according to Embodiment 1 of the present invention on a ball-disc.

The frictional abrasion curve diagram was drawn by using origin 9.0 software, as shown in FIGS. 3-4. The result showed that: the friction coefficient of pure deionized water in the atmospheric environment was 0.45, compared with that of pure deionized water, the friction coefficient of the super-lubricity water lubricant of Embodiment 1 in the atmospheric environment was reduced to 0.006, the super-lubricity behavior in a macroscopic atmospheric environment was realized, the abrasion rate was almost zero, and the in-situ assembled composite material was further proved to be capable of being used as a super-lubricity water lubricating additive for macroscopic engineering.

The foregoing descriptions are merely preferred embodiments of the present invention, but not intended to limit the present invention. A person skilled in the art may make various alterations and variations to the present invention. Any modification, equivalent replacement, or improvement made within the spirit and principle of the present invention shall fall within the protection scope of the present invention.

What is claimed is:

1. A super-lubricity water lubricating additive, wherein the super-lubricity water lubricating additive is of a hollow spherical shell structure, and the hollow spherical shell structure comprises at least one layer of spherical shell;

the spherical shell sequentially comprises a first polydopamine layer, a nanoparticle layer, a second polydopamine layer and an oxidized graphene layer from inside to outside, and nanoparticles of the nanoparticle layer are nano diamond, nano molybdenum disulfide or nano tungsten disulfide;

or the spherical shell sequentially comprises a first polydopamine layer, a nanoparticle layer, a second polydopamine layer, a graphene layer and a third polydopamine layer from inside to outside, and nanoparticles of the nanoparticle layer are nano diamond, nano molybdenum disulfide or nano tungsten disulfide.

2. A super-lubricity water lubricant, being an aqueous solution of the super-lubricity water lubricating additive according to claim 1 or the super-lubricity water lubricating additive obtained by a preparation method comprising:

preparing a first polydopamine layer on a surface of a spherical nano metal oxide, connecting nanoparticles to a surface of the first polydopamine layer to load a nanoparticle layer onto the surface of the first polydopamine layer, then, preparing a second polydopamine layer on a surface of the nanoparticle layer, enabling oxidized graphene to form an oxidized graphene layer on a surface of the second polydopamine layer through bonding hydroxyl groups or π-π bonds to surface groups of the oxidized graphene on the surface of the second polydopamine layer, and removing the nano metal oxide by an acid solution through etching, wherein the nanoparticles are nano diamond, nano molybdenum disulfide or nano tungsten disulfide;

or preparing a first polydopamine layer on a surface of a spherical nano metal oxide, connecting nanoparticles to a surface of the first polydopamine layer to load a nanoparticle layer onto the surface of the first polydopamine layer, then, preparing a second polydopamine layer on a surface of the nanoparticle layer, enabling oxidized graphene to form an oxidized graphene layer on a surface of the second polydopamine layer through bonding hydroxyl groups or π-π bonds to surface groups of the oxidized graphene on the surface of the second polydopamine layer, preparing a third polydopamine layer on a surface of the oxidized graphene layer from dopamine, reducing the oxidized graphene into graphene by dopamine during preparation of the third polydopamine layer, and removing the nano metal oxide by an acid solution through etching, wherein the nanoparticles are nano diamond, nano molybdenum disulfide or nano tungsten disulfide.

3. The super-lubricity water lubricating additive according to claim 2, wherein the process of preparing the first polydopamine layer on the surface of the spherical nano metal oxide comprises:

adding a nano metal oxide into a dopamine polymerization reaction system to take a polymerization reaction, and the dopamine polymerization reaction system comprises dopamine hydrochloride, Tris solution and hydrochloric acid.

4. The super-lubricity water lubricating additive according to claim 2, wherein the process of connecting the nanoparticles to the surface of the first polydopamine layer comprises:

adding nanoparticle dispersion liquid into a nano metal oxide solution cladded by the first polydopamine layer to be mixed for 10-24 h.

5. The super-lubricity water lubricating additive according to claim 2, wherein the process of preparing the second polydopamine layer on the surface of the nanoparticle layer comprises:

adding a composite material loaded with the nanoparticle layer on the surface of the first polydopamine layer into the dopamine polymerization reaction system to take a polymerization reaction, and the dopamine polymerization reaction system comprises dopamine hydrochloride, Tris solution and hydrochloric acid.

6. The super-lubricity water lubricating additive according to claim 2, wherein the process of forming the oxidized graphene layer on the surface of the second polydopamine layer comprises:

adding a composite material for preparing the second polydopamine layer on the surface of the nanoparticle layer into oxidized graphene dispersion liquid to be mixed for 10-24 h.

7. The super-lubricity water lubricating additive according to claim 2, wherein freeze-drying is performed after the nano metal oxide is removed through etching.

8. The super-lubricity water lubricant according to claim 2, wherein a mass concentration of the super-lubricity water lubricating additive is 0.01-1.00%.

* * * * *